United States Patent [19]

Nakase et al.

[11] Patent Number: 4,813,898

[45] Date of Patent: Mar. 21, 1989

[54] WATER JET PROPULSION

[75] Inventors: Ryoichi Nakase; Masayoshi Nanami; Seiji Inoue, all of Hamamatsu, Japan

[73] Assignee: Sanshin Kogyo Kabushiki Kaisha, Hamamatsu, Japan

[21] Appl. No.: 22,750

[22] Filed: Mar. 6, 1987

[30] Foreign Application Priority Data

Mar. 27, 1986 [JP] Japan ..... 61-67210

[51] Int. Cl.[4] ..... B63H 11/02

[52] U.S. Cl. ..... 440/111; 440/38; 440/112; 440/83

[58] Field of Search ..... 440/38, 47, 111, 112, 440/83, 87, 64, 113

[56] References Cited

U.S. PATENT DOCUMENTS

| | | | |
|---|---|---|---|
| 3,136,281 | 6/1964 | Kiekhaefer et al. | 440/112 |
| 3,324,822 | 6/1967 | Carter, III | 440/38 |
| 3,811,397 | 5/1974 | Usborne | 440/47 |
| 3,839,859 | 10/1974 | Woell, Jr. | 440/38 |
| 4,722,707 | 2/1988 | Murase | 440/38 |

*Primary Examiner*—Joseph F. Peters, Jr.
*Assistant Examiner*—Edwin L. Swinehart
*Attorney, Agent, or Firm*—Ernest A. Beutler

[57] ABSTRACT

Two embodiments of improved jet drive units for watercraft wherein the jet drive impeller shaft is coupled to the engine drive shaft by a slip spline connection for facilitating removal of the jet drive unit for servicing without removal of the engine. In addition, an improved connection is provided between the impeller shaft and the impeller that dispenses for the need for splines and thus permits a smaller impeller hub and a greater efficiency jet drive unit.

21 Claims, 3 Drawing Sheets

WATER JET PROPULSION

BACKGROUND OF THE INVENTION

This invention relates to a water jet propulsion unit and more particularly to an improved driving arrangement for a jet propulsion unit that facilitates servicing.

A popular form of watercraft is powered by a jet propulsion unit that includes a housing that defines an inlet, a pumping cavity and a discharge outlet. An impeller is rotatably journaled within the pumping cavity for drawing water from the inlet and discharging it through the outlet so as to propel the associated watercraft. This type of propulsion unit is normally mounted in a recess formed in the underside of the watercraft hull and rearwardly of the engine compartment. In normal practice, the impeller is driven by an impeller shaft that extends forwardly and which is coupled to a drive shaft driven by the engine which is contained within the engine compartment.

Frequently, the jet propulsion unit must be serviced. For example, the impeller may become damaged when foreign objects are drawn through the jet propulsion unit and, with the prior art type of constructions, it has been necessary to remove the engine from the watercraft so as to permit sufficient axial movement of the respective shafts so that the jet propulsion unit can be removed and serviced. Although splined connections have been employed between the drive shaft and the impeller shaft, the prior art type of construction have located these splined connections in the area of the hub of the impeller. As a result, it is necessary to remove the engine and to move it forwardly so as to permit the removal of the jet propulsion unit. In addition to this difficulty, the location of the splined connection at the hub of the impeller means that the hub of the impeller must be made sufficiently large so as to transmit the driving thrust without breakage. However, as the size of the hub of the impeller is increased, the efficiency of the jet propulsion unit is accordingly decreased.

It is, therefore, a principal object of this invention to provide an improved jet propulsion unit for a watercraft.

It is a further object of this invention to provide a jet propulsion unit for watercraft that can be conveniently serviced without necessitating removal of the engine from the watercraft.

It is a further object of this invention to provide an improved driving connection between the drive shaft and impeller shaft of the jet propelled watercraft so as to facilitate servicing.

It is a further object of this invention to provide an improved driving connection for a jet propulsion unit of a watercraft that will not increase the size of the impeller hub.

SUMMARY OF THE INVENTION

This invention is adapted to be embodied in a jet drive unit for a watercraft that has a hull which defines an engine compartment and a recess that is formed in the hull rearwardly of the engine compartment and which is adapted to contain the jet drive unit. The jet drive unit includes an outer housing defining a water inlet, a pumping chamber and a discharge outlet. An impeller is rotatably journaled in the pumping chamber and an impeller shaft is rotatably coupled to the impeller and extends forwardly toward the engine compartment. An engine supported in the engine compartment drives a drive shaft that extends rearwardly toward the recess. In accordance with the invention, a slip spline connection is provided between the drive shaft and the impeller shaft for rotatably coupling the drive shaft and impeller shaft and for permitting removal of the jet drive unit from the hull without removal of the engine.

DETAILED DESCRIPTION OF THE PREFERRED EMBODIMENTS

Figure 1:
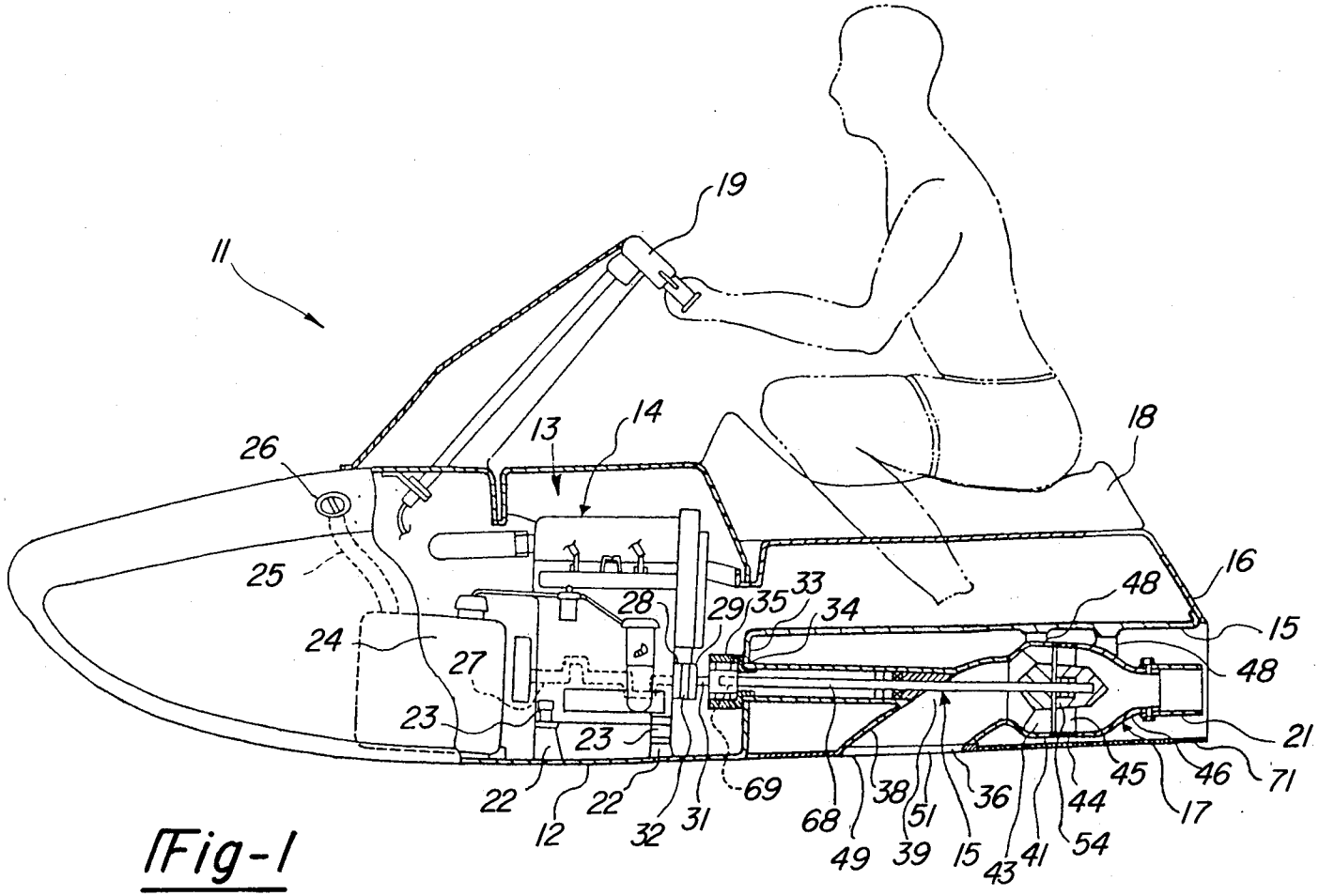
FIG. 1 is a side elevational view, with a portion broken away, of a watercraft constructed in accordance with a first embodiment of the invention.

A watercraft, constructed in accordance with a first embodiment of the invention, is identified generally by the reference numeral 11 and is shown generally in FIG. 1. The watercraft 11 is comprised of a hull assembly, indicated generally by the reference numeral 12, that defines an engine compartment 13 at its approximate midpoint in which an engine, indicated generally by the reference numeral 14, and which may be of any known type is positioned. Rearwardly of the engine compartment 13, the underside of the hull 12 is provided with a recess 15 that extends rearwardly and which terminates at the stern 16 of the hull 12. A jet propulsion unit, indicated generally by the reference numeral 17, is supported within the recess 15 for propelling the watercraft 12 in a manner to be described.

A seat 18 is formed by the hull 12 above the recess 15 and jet propulsion unit 17. The watercraft 11 is designed so as to be primarily operated by a single rider, shown in phantom in FIG. 1, sitting in straddle fashion upon the seat 18. A handlebar assembly 19 is carried forwardly of the seat 18 and is coupled to a discharge nozzle 21 of the jet propulsion unit 17 for steering it and the watercraft in a known manner.

Still referring primarily to FIG. 1, the hull 12 is provided with a plurality of spaced engine supports 22 upon which the engine 14 is mounted by means of isolating elastomeric blocks 23. In this way, the transmission of vibrations from the engine 14 to the hull 11 is reduced. Forwardly of the engine 14, the hull 12 carries a fuel tank 24 that has a fill neck 25 that extends to a fill opening 26 formed at a forward portion of the hull 12. Fuel is supplied from the fuel tank 24 to the engine 14 in any known manner.

The engine 14 has an output shaft 27 that is rotatably journaled in a known manner and which has affixed to its rearwardly projecting exposed end a coupling member 28. The coupling member 28 is connected to a similar coupling member 29 that is affixed to a drive shaft 31 by means including an elastic block 32 for shock absorption.

Referring now additionally to FIGS. 2 through 5, the engine compartment 13 is separated from the recess 15 by a generally vertically extending bulkhead 33 that is formed integrally with the hull 12. This bulkhead 33 is provided with an opening 34. A bearing carrier, indicated generally by the reference numeral 35, is affixed to the bulkhead 33 by means of a plurality of threaded fasteners 36 which enter into the bulkhead 33 from the engine compartment 13. The bearing carrier 35 carries a pair of spaced anti-friction bearings 36 which rotatably journal the drive shaft 31. In addition, an O-ring seal 37 is compressed between a flange of the bearing carrier 35 and the bulkhead 33 so as to prevent water from leaking forwardly through the opening 34 into the engine compartment 13.

The jet drive unit 17 is comprised of an outer housing that consists of a first casing 38 which defines a forwardly and downwardly opening water inlet duct 39. Affixed to the first casing 38 is a second casing 41 in which a pumping chamber 42 is formed. An impeller 43 is journaled, in a manner to be described, within the pumping chamber 42. A third casing 44 of the water jet unit 17 is positioned rearwardly of the second casing 41 and contains a plurality of straightening vanes 45 through which the water pumped by the impeller 43 passes. A rear casing 46 is affixed to the casing 44 and defines a discharge nozzle opening 47 that communicates with the steering discharge nozzle 21 for discharge of the water back to the body in which the watercraft is operating.

The jet pump unit 17 is supported within the hull 12 by means of supporting brackets 48 that are formed in the hull around the recess 15 and to which the jet drive unit 17 is affixed in any suitable manner.

An intake plate 49 is affixed to the jet drive unit housing 38 across the opening of the inlet duct 39. The inlet plate 49 is provided with a plurality of openings 51 that define the inlet for water to the duct 39. Bars 52 separate the openings 51 and prevent the ingestion of large articles into the inlet duct 39.

The impeller housing 44 is provided with an annular boss 53 in which a pair of spaced anti-friction bearings 54 are supported. The bearings 54, in turn, support the rear end of an impeller shaft, indicated generally by the reference numeral 55. Forwardly of the bearings 54, the impeller shaft 55 is provided with a male threaded portion 56 that is screwed into a corresponding female threaded opening 57 formed in the hub 58 of the impeller 43. The hand of the threads 56 and 57 is such that the normal rotation of the impeller shaft 55 will tend to cause tightening of these threads.

Oil seals 59 are carried on the housing hub 53 and engage the impeller shaft 55 forwardly of the bearings 54 for preventing water leakage into these bearings. A nacel 61 is affixed to the hub portion 53 by threaded fasteners with an interposed O-ring seal 62 so as to provide a seal for the rear portion of the bearing 54. The nacel 61 extends into the discharge duct 47 so as to provide a smooth water flow as well as the aforenoted sealing.

The impeller shaft 55 extends forwardly from the impeller 43 and passes through a guide plate 63 that is affixed to an opening formed in the jet drive unit housing 38 so as to prevent leakage. An annular sleeve 64 encircles and extends forwardly from the plate 63 and carries a anti-friction bearing 65 and seal 66 at its rear end for sealing and supporting the intermediate portion of the impeller shaft 55.

The sleeve 64 encircles a pilot portion that extends rearwardly from the bearing carrier 35 and an O-ring seal 67 is provided in this area so as to insure water tight sealing around the impeller shaft 55.

The forward end of the impeller shaft 55 is provided with a male splined portion 68 that cooperates with a female splined portion 69 of the drive shaft 31 for providing a sliding spline connection between these shafts so as to transmit rotary drive while permitting disassembly.

Figure 2:
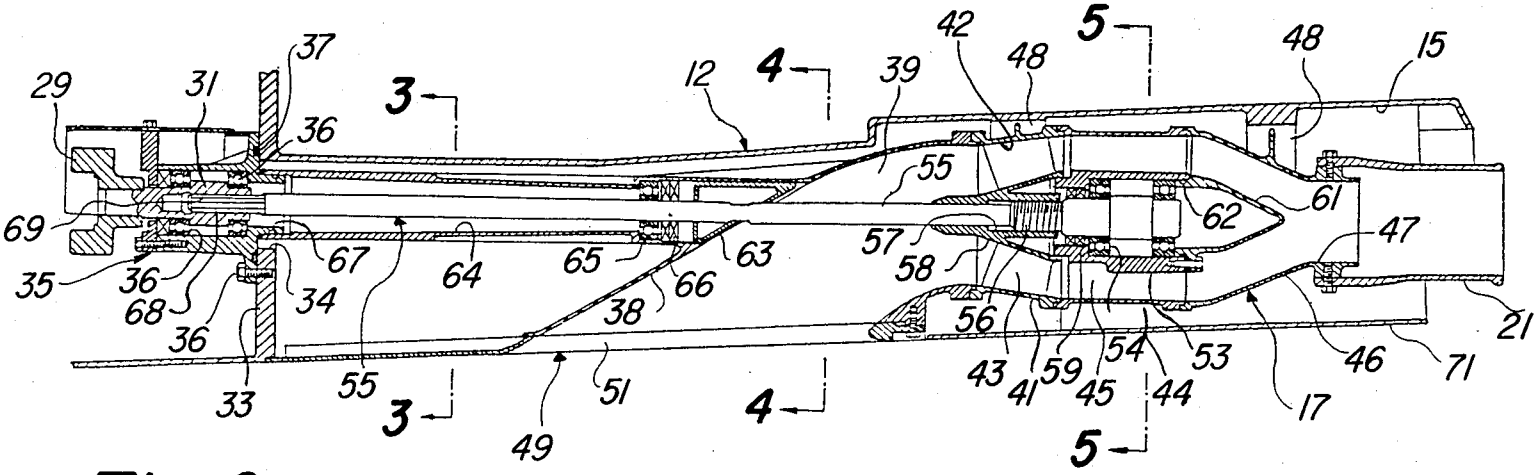
FIG. 2 is an enlarged cross-sectional view showing the jet drive unit and its connection to the engine.
Figure 5:
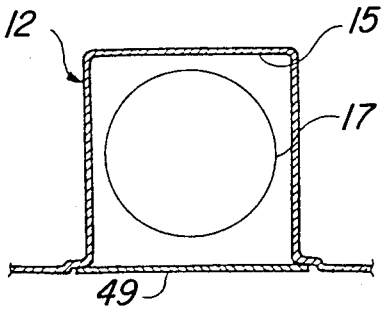
FIG. 5 is a cross-sectional view taken along the line 5—5 of FIG. 4.
Figure 4:
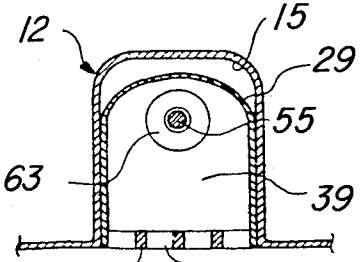
FIG. 4 is a cross-sectional view taken along the line 4—4 of FIG. 2.
Figure 3:
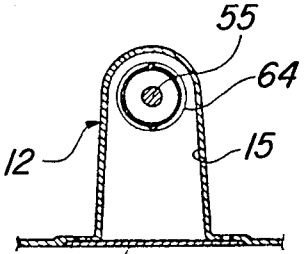
FIG. 3 is a cross-sectional view taken along the line 3—3 of FIG. 2.

It should be readily apparent from an inspection of FIG. 2 that the jet drive unit 17 may be conveniently removed from the watercraft by disconnecting its connection to the supporting bosses 48. The entire housing assembly and impeller shaft 55 may then be withdrawn rearwardly due to the splined connection 68 and 69 with the drive shaft 31 without necessitating removal of the engine so as to permit longitudinal movement. Thus, the unit can be conveniently removed and the impeller 43 removed by reversing the rotation of the impeller shaft 55 to unscrew the screw threaded connections 56 and 57. Therefore, servicing is facilitated. Furthermore, since there is no splined connection between the impeller shaft 55 and the impeller 43, the hub 58 of the impeller 43 may be made quite small and good flow efficiency will result.

It should be noted that the rear end of the hull recess 15 and the area beneath the rear portion of the jet drive unit 17 is closed by a further baffle plate 71 that is affixed in any suitable manner to the underside of the hull 12.

Figure 6:
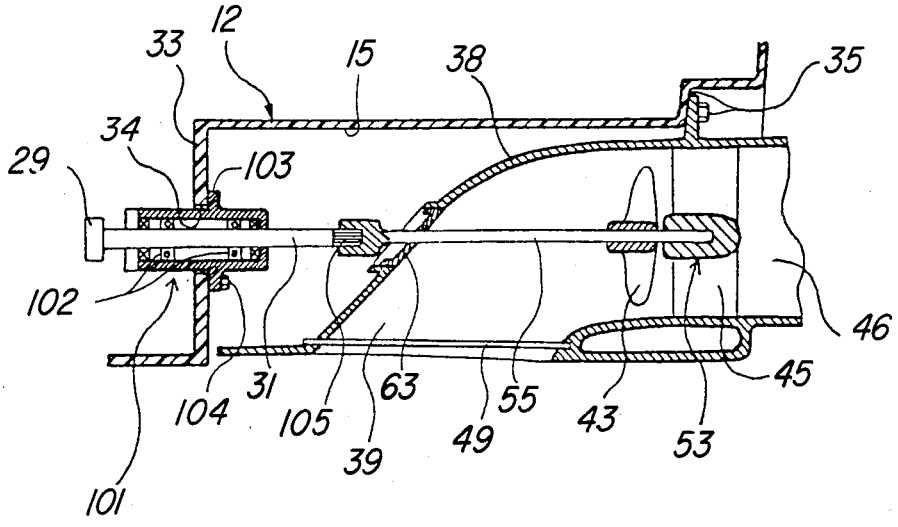
FIG. 6 is a cross-sectional view, in part similar to FIG. 2, showing another embodiment of the invention.

In the embodiment thus far described, the bearing housing 35 for supporting the drive shaft was mounted on the engine compartment side of the bulkhead 33. In addition, the splined connection between the drive shaft and the impeller shaft was contained within this bearing housing. FIG. 6 shows another embodiment of the invention which differs from the previously described embodiment only in the mounting of the bearing housing and the location of the splined connection. Because of these basic similarities, components of this embodiment which are the same or substantially the same as the previously described embodiment have been identified by the same reference numerals.

In this embodiment, a bearing housing 101 carries a pair of spaced apart bearings 102 and has an outwardly extending flange 103 that is affixed to the rear face of the bulkhead 33 within the recess 15 by means of threaded fasteners 104. In this way, the bearing housing 101 may be removed rearwardly and without necessitating removal from the engine compartment. Also in this embodiment, the drive shaft 31 extends rearwardly into the recess 15 and,between the bulkhead 33 and the forward portion of the jet pump housing part 38, there is provided a splined connection 105 between the drive shaft 31 and the impeller shaft 55. Thus, this embodiment may be disassembled as with the previously described embodiment and has the same advantages.

It should be readily apparent from the foregoing description that two embodiments of the invention have been illustrated and described and each of which provides a very effective arrangement for coupling a jet drive unit to the powering engine of a watercraft. In addition, the construction is such that disassembly is possible for servicing of the jet drive unit without removing the engine. In addition, by relocating the splined connection between the impeller shaft and the drive shaft, a smaller hub may be employed for the impeller shaft and the jet unit has greater efficiency.

Although two embodiments of the invention have been illustrated and described, various changes and modifications may be made without departing from the spirit and scope of the invention, as defined by the appended claims.

I claim:

1. In a jet drive unit for a watercraft having a hull defining an engine compartment, a recess formed in said hull rearwardly of said engine compartment and adapted to contain a jet drive unit including an outer housing defining a water inlet, a pumping chamber and a discharge outlet, an impeller rotatably journaled in said pumping chamber, an impeller shaft rotatably coupled to said impeller and extending forwardly toward said engine compartment, said jet drive unit being detachably supported as a unit within said recess, an engine supported within said engine compartment and driving a drive shaft extending rearwardly toward said recess, the improvement comprising a slip spline connection between said drive shaft and said impeller shaft for rotatably coupling said drive shaft and said impeller shaft and positioned and configured for permitting removal of said jet drive unit as a unit from said hull recess without removal or release of said engine from its support in said engine compartment.

2. In a jet drive unit as set forth in claim 1 wherein the recess is separated from the engine compartment by a bulkhead having an opening through which at least one of the shafts extend and wherein the splined connection is disposed in juxtaposition to said bulkhead.

3. In a jet drive unit as set forth in claim 2 further including a bearing housing affixed to said bulkhead and rotatably journaling one of the shafts.

4. In a jet drive unit as set forth in claim 1 wherein the recess is separated from the engine compartment by a bulkhead having an opening through which at least one of the shafts extend and wherein the splined connection is disposed in juxtaposition to said bulkhead.

5. In a jet drive unit as set forth in claim 4 further including a bearing housing affixed to said bulkhead and rotatably journaling one of the shafts.

6. In a jet drive unit as set forth in claim 5 wherein the shaft journaled by the bearing housing comprises the drive shaft and wherein the bearing housing is affixed to the engine compartment side of the bulkhead, the splined connection being contained with the bearing housing.

7. In a jet drive unit as set forth in claim 5 wherein the bearing housing is affixed to the recess side of the bulkhead and wherein the drive shaft is journaled within the bearing housing and extends rearwardly therefrom, the splined connection being positioned rearwardly of the bearing housing.

8. In a jet drive unit as set forth in claim 7 wherein the bearing housing may be removed rearwardly into the recess.

9. In a jet drive unit for a watercraft having a hull defining an engine compartment, a recess formed in said hull rearwardly of said engine compartment and separated therefrom and having an opening thereon, said recess being adapted to contain a jet drive unit including an outer housing defining a water inlet, a pumping chamber and a discharge outlet, an impeller rotatably journaled in said pumping chamber, an impeller shaft rotatably coupled to said impeller and extending forwardly toward said engine compartment, said jet drive unit being detachably supported as a unit within said recess, an engine supported within said engine compartment and driving a drive shaft extending rearwardly toward said recess, the improvement comprising at least one of said shafts extending through said bulkhead opening, a slip spline connection between said drive shaft and said impeller shaft in juxtaposition to said bulkhead for rotatably coupling said drive shaft and said impeller shaft and for permitting removal of said jet drive unit from said hull without removal of said engine, a bearing housing affixed to said bulkhead and journaling one of said shafts, said shaft journaled by said bearing housing comprising said drive shaft and wherein said bearing housing is affixed to the engine compartment side of said bulkhead, said splined connection being contained with said bearing housing.

10. In a jet drive unit as set forth in claim 9 further including a screw connection between the impeller shaft and the impeller.

11. In a jet drive unit for a watercraft having a hull defining an engine compartment, a recess formed in said hull rearwardly of said engine compartment and separated therefrom and having an opening thereon, said recess being adapted to contain a jet drive unit including an outer housing defining a water inlet, a pumping chamber and a discharge outlet, an impeller rotatably journaled in said pumping chamber, an impeller shaft rotatably coupled to said impeller and extending forwardly toward said engine compartment, said jet drive unit being detachably supported as a unit within said recess, an engine supported within said engine compartment and driving a drive shaft extending rearwardly toward said recess, the improvement comprising at least one of said shafts extending through said bulkhead opening, a slip spline connection between said drive shaft and said impeller shaft in juxtaposition to said bulkhead for rotatably coupling said drive shaft and said impeller shaft and for permitting removal of said jet drive unit from said hull without removal of said engine, a bearing housing affixed to said bulkhead and journaling one of said shafts, said bearing housing is affixed to the recess side of said bulkhead and wherein said drive shaft is journaled within said bearing housing and extends rearwardly therefrom, said splined connection being positioned rearwardly of said bearing housing.

12. In a jet drive unit as set forth in claim 11 wherein the bearing housing may be removed rearwardly into the recess.

13. In a jet drive unit as set forth in claim 11 further including a screw connection between the impeller shaft and the impeller.

14. In a jet drive unit as set forth in claim 13 wherein the bearing housing may be removed rearwardly into the recess.

15. In a jet drive unit for a watercraft having a hull defining an engine compartment, a recess formed in said hull rearwardly of said engine compartment and adapted to contain a jet drive unit including an outer housing defining a water inlet, a pumping chamber and a discharge outlet, an impeller rotatably journaled in said pumping chamber, an impeller shaft rotatably coupled to said impeller and extending forwardly toward said engine compartment, an engine supported within said engine compartment and driving a drive shaft extending rearwardly toward said recess, a bulkhead extending across said hull between said recess and said engine compartment the improvement comprising a bearing housing affixed to said bulkhead and rotatably journaling said drive shaft, a slip spline connection between said drive shaft and said impeller shaft for rotatably coupling said drive shaft and said impeller shaft and for permitting removal of said jet drive unit from said hull without removal of said engine, said slip spline connection being contained within said bearing housing.

16. In a jet drive unit as set forth in claim 15 wherein the recess is separated from the engine compartment by the bulkhead.

17. In a jet drive unit as set forth in claim 15 wherein the bearing housing is affixed to the engine compartment side of the bulkhead.

18. In a jet drive unit as set forth in claim 15 further including a screw connection between the impeller shaft and the impeller.

19. In a jet drive unit for a watercraft having a hull defining an engine compartment, a recess formed in said hull rearwardly of said engine compartment and adapted to contain a jet drive unit including an outer housing defining a water inlet, a pumping chamber and a discharge outlet, an impeller rotatably journaled in said pumping chamber, an impeller shaft rotatably coupled to said impeller and extending forwardly toward said engine compartment, an engine supported within said engine compartment and driving a drive shaft extending rearwardly toward said recess, a bulkhead extending across said hull between said recess and said engine compartment the improvement comprising a bearing housing affixed to said bulkhead and rotatably journaling said drive shaft, said drive shaft extending through said bulkhead with said bearing housing being affixed to the rear side of said bulkhead, a slip spline connection between said drive shaft and said impeller shaft for rotatably coupling said drive shaft and said impeller shaft and for permitting removal of said jet drive unit from said hull without removal of said engine, said slip spline connection being positioned rearwardly of said bearing housing.

20. In a jet drive unit as set forth in claim 19 wherein the bearing housing may be removed rearwardly into the recess.

21. In a jet drive unit as set forth in claim 19 further including a screw connection between the impeller shaft and the impeller.

* * * * *

UNITED STATES PATENT AND TRADEMARK OFFICE

CERTIFICATE OF CORRECTION

PATENT NO. : 4,813,898

DATED : March 21, 1989

INVENTOR(S) : Nakase, et. al.

It is certified that error appears in the above-identified patent and that said Letters Patent is hereby corrected as shown below:

Claim 19, line 17, please change "the" to –a--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*